US008579317B2

(12) United States Patent
Merino et al.

(10) Patent No.: US 8,579,317 B2
(45) Date of Patent: Nov. 12, 2013

(54) BINDING FOR A BOOT ON A GLIDING BOARD

(71) Applicant: Salomon S.A.S., Metz-Tessy (FR)

(72) Inventors: Jean-François Merino, Epagny (FR); Daniel Soldan, Seynod (FR)

(73) Assignee: Salomon S.A.S., Metz-Tessy (FR)

( * ) Notice: Subject to any disclaimer, the term of this patent is extended or adjusted under 35 U.S.C. 154(b) by 0 days.

(21) Appl. No.: 13/621,999

(22) Filed: Sep. 18, 2012

(65) Prior Publication Data

US 2013/0069342 A1 Mar. 21, 2013

(30) Foreign Application Priority Data

Sep. 19, 2011 (FR) ..... 11 02836
Jan. 27, 2012 (FR) ..... 12 00256

(51) Int. Cl.
*A63C 9/00* (2012.01)

(52) U.S. Cl.
USPC ..... 280/611

(58) Field of Classification Search
USPC ..... 280/611–634, 608, DIG. 13
See application file for complete search history.

(56) References Cited

U.S. PATENT DOCUMENTS

| | | | | |
|---|---|---|---|---|
| 3,741,576 | A | 6/1973 | Salomon | |
| 4,095,821 | A | 6/1978 | Salomon | |
| 4,184,696 | A * | 1/1980 | Settembre | 280/615 |
| 4,765,641 | A | 8/1988 | Peyre | |
| 6,585,283 | B2 | 7/2003 | Merino et al. | |
| 6,588,791 | B1 | 7/2003 | Horn | |

FOREIGN PATENT DOCUMENTS

| | | | |
|---|---|---|---|
| AT | 358 447 | B | 9/1980 |
| CH | 686 707 | A5 | 6/1996 |
| EP | 0 241 360 | A1 | 10/1987 |
| EP | 1 151 765 | A1 | 11/2001 |
| EP | 2 174 695 | A1 | 4/2010 |
| FR | 2 087 117 | A5 | 12/1970 |
| FR | 2 314 742 | A1 | 1/1977 |
| FR | 2 646 094 | A1 | 10/1990 |
| FR | 2 666 513 | A1 | 3/1992 |
| WO | WO-00/29078 | A1 | 5/2000 |

OTHER PUBLICATIONS

Anonymous: "ess v.a.r. mounting video", Jan. 14, 2012, XP55032104, Internet URL: http://pub.ne.jp/hirarin7/?entry_id=2560735 (retrieved from the Internet Jul. 6, 2012).

* cited by examiner

*Primary Examiner* — John Walters
*Assistant Examiner* — James Triggs
(74) *Attorney, Agent, or Firm* — Greenblum & Bernstein, P.L.C.

(57) ABSTRACT

The invention is directed to a binding for retaining a boot on a gliding board, such as a ski, which includes a retaining device, a lower abutment surface, and a vertical spacer. The retaining device supports an upper abutment surface adapted to be in contact with at least one upper surface of a front portion of the boot. The lower abutment surface is adapted to be in contact with at least a portion of the sole of the boot. The lower abutment surface is connected to the retaining device so as to define an engagement height for the boot corresponding to the difference in height between the upper abutment surface and the lower abutment surface. The vertical spacer is rigid and includes a predetermined adjustment height. The vertical spacer is arranged relative to the retaining device and the lower abutment surface, so that the adjustment height of the vertical spacer makes it possible to adjust the engagement height. The vertical spacer is affixed directly to the retaining device in order to modify the vertical position of the upper abutment surface.

18 Claims, 10 Drawing Sheets

BINDING FOR A BOOT ON A GLIDING BOARD

CROSS-REFERENCE TO RELATED APPLICATIONS

This application is based upon French patent application Ser. No. 11/02836, filed Sep. 19, 2011, and French patent application Ser. No. 12/00256, filed Jan. 27, 2012, the disclosures of which are hereby incorporated by reference thereto in their entireties, and the priorities of which are claimed under 35 USC §119.

BACKGROUND

1. Field of the Invention

The present invention relates to a binding for footwear, such as a boot, on a gliding board, such as a ski or a snowboard, and to a gliding board equipped with such a binding.

2. Background Information

A binding for securing a boot on a gliding board, such as a ski, generally includes a front retaining device, referred to as the "toe-piece", and a rear retaining device, referred to as the "heel-piece". The ski boot is interposed between the toe-piece and the heel-piece, these elements being fixed on the ski, i.e., on the gliding board. Thus, the combined action of the two retaining devices makes it possible to affix the boot to the ski longitudinally. To block the vertical movement of the boot, the toe-piece and the heel-piece are equipped with stop mechanisms acting on the boot.

Various solutions exist for making a toe-piece or a heel-piece. For example, the documents EP-A-241 360 (or family member U.S. Pat. No. 4,765,641), EP-A-1 151 765 (or family member U.S. Pat. No. 6,585,283), and EP-A-2 174 695 disclose various toe-piece embodiments. As shown in the drawing figures of these examples, the front retaining device has a pair of front wings forming a "V", whose legs partially cover a front extension of the ski boot. Moreover, the lower surface of the sole of the boot presses on a support element fixed on the ski. Consequently, the vertical immobilization of the boot in the area of the toe-piece is achieved by this double contact, i.e., the contact between the upper surface of the front extension of the boot and the wings of the toe-piece, on the one hand, and the contact between the sole of the boot and the support element, on the other hand.

For safety reasons, the toe-piece and the heel-piece often incorporate a safety mechanism for releasing the binding if necessary. These mechanisms make it possible to free the user's foot to avoid injuries in the event of an accidental transverse movement of the foot, which may occur during a fall, for example, or, generally speaking, to protect the foot from injuries when the forces exerted on the boot exceed predetermined values. Safety mechanisms for the toe-piece are also described in the documents mentioned above.

There are several types of ski boots, including alpine ski boots and touring ski boots. These two categories are classified by the NF ISO 5355 and NF ISO 9523 standards, respectively. These ski boots distinguish over one another in particular by the dimensions of the portions interfacing with the components of the binding. Due to these substantial dimensional variations, bindings are specific to a category of boot.

Certain toe-pieces include a mechanism enabling elastic adjustment of the height, or vertical positioning, of the wings. This elastic mechanism serves to compensate for small dimensional variations related to the manufacture of boots of the same category.

Similarly, there are bindings whose support element interfacing with the sole of the boot is mounted on an elastic mechanism in order to compensate for the dimensional variations inherent in a boot category.

Other toe-pieces are divided into two portions, the portion incorporating the wings being adjustable in height, via an adjusting screw, with respect to the other portion fixed to the ski. A toe-piece of this type is complex and expensive. This toe-piece is hardly compatible with a mechanism for compensating for the dimensional variations inherent in a category. This design does not make it possible to cover large dimensional variations. In addition, this solution can be fragile in that the portion incorporating the wings is retained only by the adjusting screw. Furthermore, the height adjustment of the wings for compatibility with a boot category is not obvious because the adjustment is endless, with the screw being driven without reference marking. It is therefore not easy to properly adjust the height of the wings for a particular boot category. Moreover, this type of adjustment to adapt to a boot category is not convenient for the user, as it is necessary to move the portion incorporating the wings over a long path, thereby requiring several turns of the screwdriver. Finally, the height configured can be altered relatively easily by acting on the adjusting screw.

SUMMARY

The foregoing are drawbacks that the invention seeks particularly to overcome by providing a binding compatible with various categories of footwear, or boots, in which the same retaining device is used to obtain bindings that are adaptable to various categories of footwear.

In particular, the invention employs the same front retaining device to obtain bindings adaptable to various categories of boots.

The invention enables an adjustment of the binding that is simple, robust, and easy to carry out. More particularly, the invention makes it possible to modify the configuration of the binding in order to switch from one category to another via a direct, foolproof adjustment.

Further, the invention uses a retaining device incorporating a mechanism for compensating for the dimensional variations inherent in a category of boots.

The invention provides a binding for securing a boot on a gliding board, the binding including a retaining device, a lower abutment surface and a vertical spacer. The retaining device supports an upper abutment surface adapted to be in contact with at least an upper surface of a front portion of the boot. The lower abutment surface is adapted to be in contact with at least a portion of the sole of the boot. The lower abutment surface is connected to the retaining device so as to define an engagement height for the boot corresponding to the difference in height between the upper abutment surface and the lower abutment surface. The vertical spacer is rigid and includes a predetermined adjustment height. The vertical spacer is arranged in relation to the retaining device and the lower abutment surface so that the adjustment height of the vertical spacer makes it possible to adjust the engagement height.

The vertical spacer of the binding is directly affixed to the retaining device in order to modify the vertical position of the upper abutment surface.

This solution makes it possible to easily switch from one configuration suitable for a category of boot to another configuration suitable for another category of boot, by changing a single element—in this case the vertical spacer—and by keeping the same front retaining device. In this case, the front retaining device can be standard, simple, and compact. Thus, this toe-piece does not require a large range of height adjustment, which simplifies the design of the retaining device and makes it more robust, or stronger.

According to advantageous but not essential aspects of the invention, the binding can incorporate one or more of the following features, taken in any technically possible combination:

- the vertical spacer connects the retaining device to the gliding board, the lower abutment surface being directly connected to the gliding board;
- the vertical spacer connects the retaining device to a base affixed to the gliding board, the base supporting the lower abutment surface;
- the base is rotationally movable about an axis transverse to the gliding board;
- the vertical spacer is arranged between the retaining device and the front portion of the footwear;
- the retaining device includes two fitted wings supporting the upper abutment surface, each fitted wing including a support on which the vertical spacer, forming the upper abutment surface, is removably fixed;
- the vertical spacer is fixed on the support, without separating the retaining device from the gliding board;
- the vertical spacer is mounted on a fitted wing along a direction generally parallel to the abutment surfaces;
- each fitted wing includes a support, a lower surface of which, facing the lower abutment surface, is vertically spaced from the lower abutment surface when the retaining device is affixed to the gliding board, by a distance greater than or equal to at least two different values of the interface height of specific footwear;
- the retaining device includes at least one roller for guiding the footwear portion during removal of the footwear, rotatably mounted about a shaft;
- the vertical spacer includes at least one notch for the passage of the shaft supporting the roller;
- the vertical spacer includes means for positioning the roller;
- the vertical spacer is mounted on the fitted wing via snap-fastening to the shaft; and
- the vertical spacer is fixed to the retaining device by at least one screw.

The invention also relates to a gliding board equipped with such a binding.

BRIEF DESCRIPTION OF DRAWINGS

Other characteristics and advantages of the invention will be better understood from the description which follows, with reference to the annexed drawings illustrating, by way of non-limiting embodiments, how the invention can be embodied, and in which:

FIGS. 1 to 16 show various embodiments of the front portion 10 of a binding 1 of a boot 2*a* or 2*b* on a ski 3.

DETAILED DESCRIPTION

Figure 1:
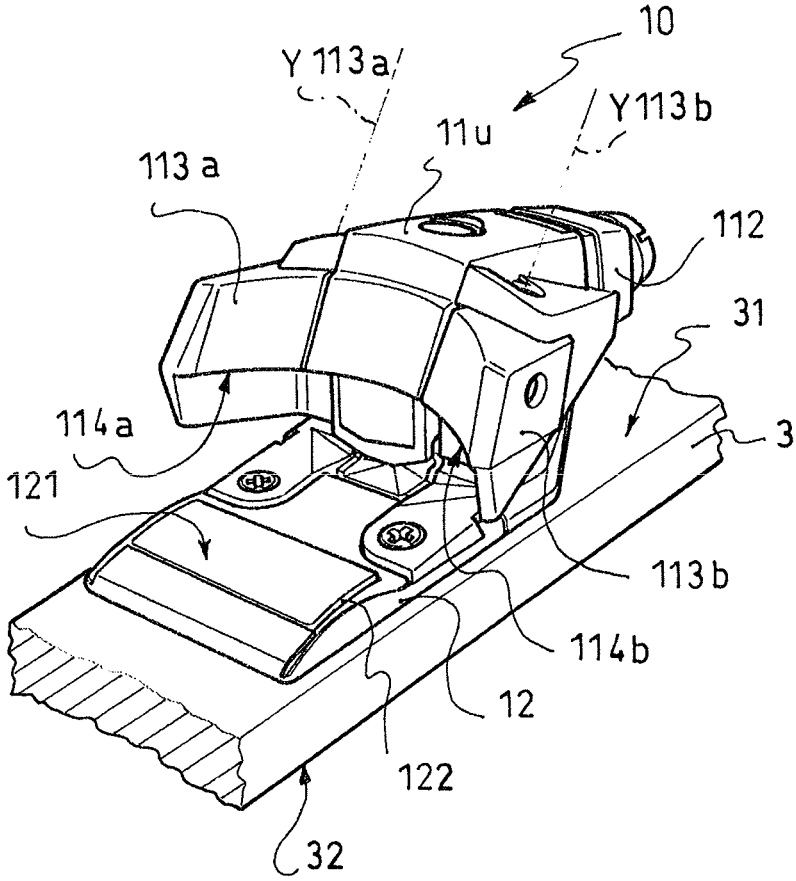
FIG. 1 is a partial perspective view of a ski equipped with a known toe-piece.

The ski 3 is demarcated by an upper surface 31, on which the binding 1 is fixed, and by a gliding surface 32, opposite the upper surface 31 and in contact with snow during use of the ski 3.

The binding 1 includes a front portion 10 and a rear portion, the latter not shown. The rear portion includes a rear retaining device, commonly referred to as the "heel-piece". The front portion 10 includes a front retaining device 11, 11*u*, 11*v*, 11*w*, commonly referred to as the "toe-piece", a base plate 12 and, depending upon the desired configuration, a vertical spacer 131, 132, 133, 135*a*, 135*b*, 136*a*, 136*b*, 137*a*, 137*b*. The use of the vertical spacer makes it possible to modify the configuration of the binding so that the binding is adapted to retain a predetermined category of footwear. For convenience, in the following description, the term "boot" is used but not to limit, in relation to the term "footwear," the type of footwear for which the invention can be employed.

There are various types of boots 2*a*, 2*b*. In these examples, two categories of boots are illustrated, including alpine ski boots 2*a* and touring ski boots 2*b*. The dimensions of these boots are standardized. The relevant standards are NF ISO 5355 for alpine ski boots 2*a* and NF ISO 9523 for touring ski boots 2*b*. These standards in particular characterize the interface between the boot and the toe-piece, thus defining a front extension 21 extending at the front of the footwear. The extension 21 includes an upper surface 22. From this extension is measured an interface height Ha, Hb corresponding to the difference in height between the upper surface 22 and lower surface 23 of the sole of the boot, that is to say, the lower surface of the boot 2*a*, 2*b*. For alpine ski boots, the standard requires an interface height Ha of 19±1 mm for an A-type boot or 16.5±1.5 mm for a C-type boot. For touring ski boots, the standard requires an interface height Hb of 28±3 mm.

The blocking of the vertical displacement of a boot, that is to say, along a direction perpendicular to the upper surface 31 of the ski 3, is ensured by the binding 1. In the area of the front portion 10, the vertical stop in one direction is obtained via contact between the lower surface 23 of the sole of the boot 2*a*, 2*b* and a lower abutment surface 121 demarcating the upper portion of a support element 122 arranged on a base plate 12. The vertical stop in the other direction is obtained via contact between the upper surface 22 of the extension 21 of the boot and an upper abutment surface 111 supported by the retaining device 11, 11*u*, 11*v*, 11*w*. The retaining device 11, 11*u*, 11*v*, 11*w* and the base plate 12 are connected, thereby making it possible to define a boot engagement height P corresponding to the difference in height between the upper abutment surface 111 and the lower abutment surface 121, as seen in FIG. 2.

To ensure proper retention of the boot, the engagement height P must correspond substantially to the interface height Ha, Hb of the boot. Advantageously, the retaining device 11, 11*u*, 11*v*, 11*w* can include a complementary structure for the elastic adjustment of the engagement height. This complementary structure, not shown, is known for alpine ski boot bindings and makes it possible to compensate for small dimensional variations in height. For example, U.S. Pat. No. 5,388,851, the disclosure of which is hereby incorporated by reference thereto in its entirety, discloses a structure for an automatic elastic adjustment for such variations. It is therefore possible to cover the standardized tolerance of the interface height, for example a tolerance of 2 mm indicated by the standard for an alpine ski boot. This adjustment structure should not compensate for greater variation as this would cause a greater preloading of the boot, thereby running the risk of heavily penalizing, or even blocking, the toe-piece release mechanism. Consequently, this adjustment structure is not suitable for compensating for variation from an alpine ski boot category to a touring ski boot category, because a variation of more than 9 mm is required to obtain this change.

The toe-piece 11*u*, 11*v*, 11*w* itself has a conventional structure. FIG. 1 shows an example of a non-limiting embodiment of this toe-piece. The toe-piece 11*u* includes a body 112 supporting two wings 113*a*, 113*b*, each being rotationally movable about a substantially vertical axis Y113*a*, Y113*b*. Each wing 113*a*, 113*b* has a lower surface 114*a*, 114*b*. These two lower surfaces 114*a*, 114*b* are substantially coplanar and substantially parallel to the upper surface 31 of the ski 3. These two lower surfaces are opposite the upper surface 31. The toe-piece 11*u* also incorporates an adjustable release mechanism making it possible to space the wings apart by means of a predetermined lateral force, thus releasing the boot from the binding. In a particular, non-limiting embodiment, the toe-piece includes a complementary structure for the elastic adjustment of the engagement height, as mentioned above. The body 112 of the toe-piece 11*u* can be fixed directly on the ski 3 or on the base plate 12, as shown in FIG. 1.

Figure 2:
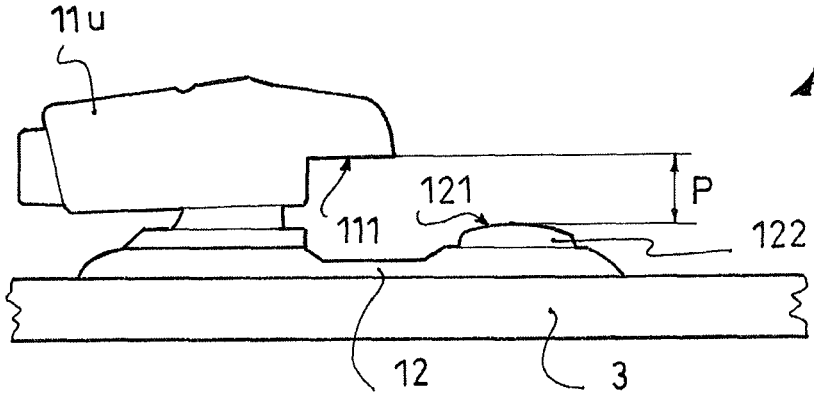
FIG. 2 is a schematic side view of a ski equipped with the front portion of a binding adapted to be compatible with a first category of footwear, according to a first embodiment.
Figure 3:
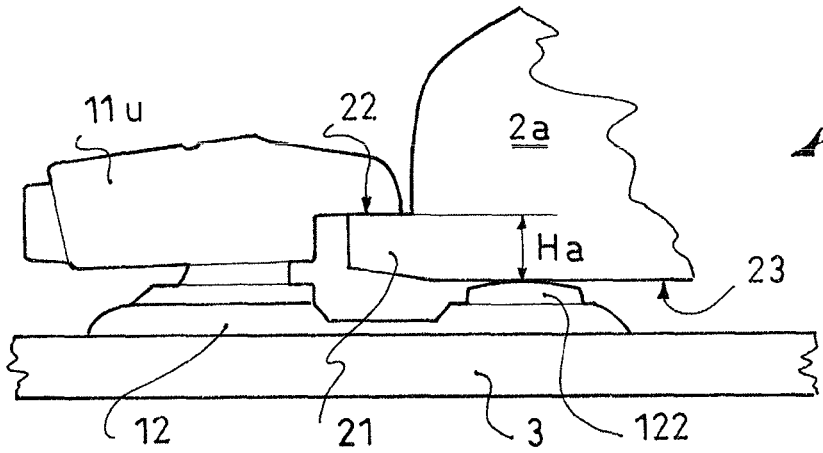
FIG. 3 is a view similar to FIG. 2, in which the footwear is shown.
Figure 4:
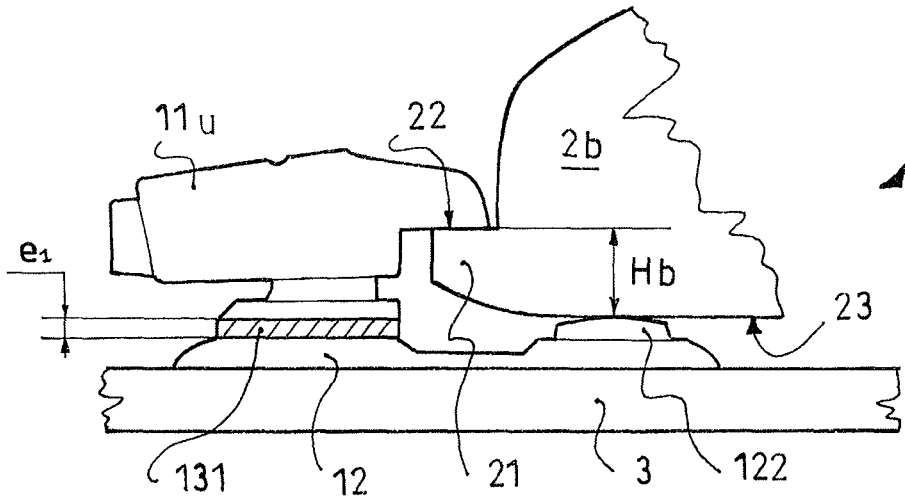
FIG. 4 is a schematic side view of a ski equipped with the front portion of a binding adapted to be compatible with a second category of footwear, according to a first embodiment.

FIGS. 2-4 illustrate a first embodiment of the invention.

FIGS. 2 and 3 show a first configuration of the binding adapted to retain a first category of boot, namely, an alpine ski boot 2*a*. According to this first configuration, the toe-piece 11*u* is directly fixed on the base plate 12. The base plate 12 is fixed on the ski 3. The support element 122 is supported by the base plate 12, arranged on the ski 3, in an area at the rear of the toe-piece 11*u*. The upper portion of the support element 122 forms the lower abutment surface 121 of the binding. The toe-piece 11*u* supports the upper abutment surface 111 of the binding. In this example, the upper abutment surface 111 corresponds to the lower surfaces 114*a*, 114*b* of the wings 113*a*, 113*b* of a toe-piece as shown in FIG. 1. The engagement height P expresses the difference in height between the upper abutment surface 111 and the lower abutment surface 121. Thus configured, the engagement height P is substantially equal to the interface height Ha characterizing an alpine ski boot 2*a*.

To adapt the binding to another category of boot, such as a touring ski boot 2*b*, for example, the solution is to insert a vertical spacer 131 between the toe-piece 11*u* and the base plate 12. In a simplified version, this vertical spacer 131 is a simple plate having a thickness e1, as shown in FIG. 4. Alternatively, the vertical spacer is a more elaborate element locally including, i.e., a portion of which including, an insert portion adapted to space the toe-piece apart from the base plate. This insert portion is characterized by a predetermined adjustment height. The insert portion forms the interface between the toe-piece 11*u* and the base plate 12. Consequently, the insert portion directly defines the engagement height P. The adjustment height corresponds to the thickness e1. Thus, the toe-piece 11*u* is no longer fixed directly on the base plate 12: the toe-piece 11*u* is fixed on the vertical spacer 131 which itself is fixed on the base plate 12. Accordingly, the position of the upper abutment surface 111 is modified. It is shifted vertically upward, which has the effect of increasing the engagement height P to be equal to the value "Ha+e1," whereby the interface height Ha or the engagement height of the first configuration is added to the dimension e1 of the vertical spacer 131. Thus, the choice of the dimension e1 of the vertical spacer 131 is critical in adjusting the engagement height P in this second configuration. A new value of the engagement height P substantially equal to the interface height Hb characterizing an alpine ski boot 2*b* can therefore be obtained. The dimension e1 is substantially equal to the value "Hb-Ha."

Figure 5:
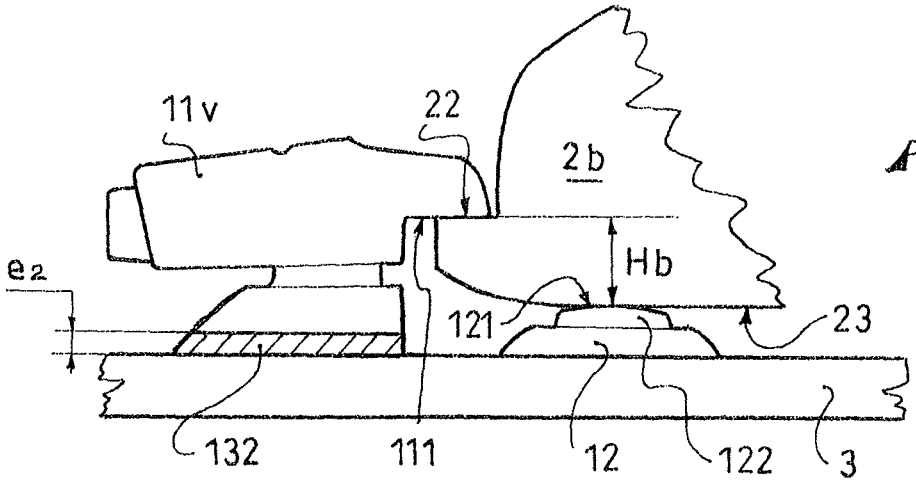
FIG. 5 is a schematic side view of a ski equipped with the front portion of a binding adapted to be compatible with a second category of footwear, according to a second embodiment.

FIG. 5 illustrates a second embodiment of the invention.

The second configuration of the binding shown is adapted to retain a second category of boot, in this case, a touring ski boot 2*b*.

This solution differs from the previous embodiment in that the toe-piece 11*v* is connected to the ski, and no longer to the base plate 12. According to this embodiment, the toe-piece 11*v* is fixed on a vertical spacer 132 having an adjustment height or thickness e2, which itself is fixed directly on the ski 3. The toe-piece 11*v* is slightly different from the first embodiment because the body 112 is a little higher. According to this second configuration, the engagement height P is substantially equal to the interface height Hb.

To switch to the first configuration, that is to say, to obtain the binding that is adapted to the category of alpine ski boots 2*a*, it suffices to remove the vertical spacer 132. The new engagement height P is then reduced by the dimension e2 and is therefore equal to the value "Hb−e2", that is to say, the difference between the interface height Hb or the engagement height of the second configuration and the dimension e2 of the vertical spacer 132. As a result, the dimension e2 is substantially equal to the value "Hb−Ha" and is therefore equivalent to e1.

Figure 6:
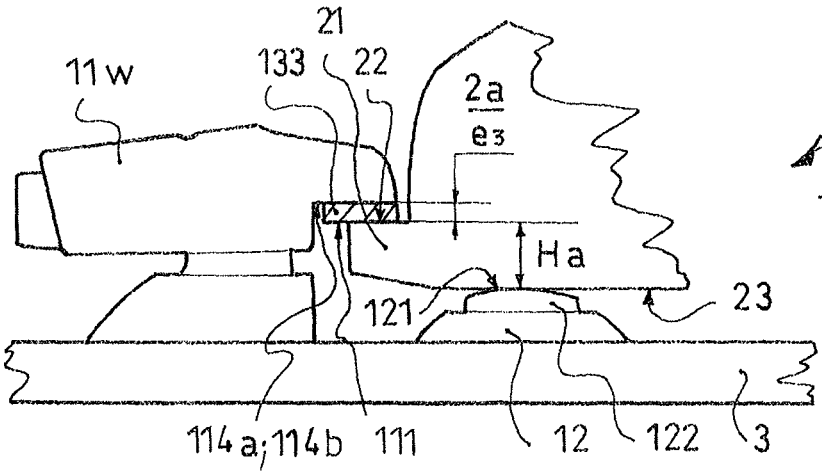
FIG. 6 is a schematic side view of a ski equipped with the front portion of a binding adapted to be compatible with a first category of footwear, according to a third embodiment.

FIG. 6 illustrates a third embodiment of the invention.

The first configuration of the binding shown is adapted to retain a first category of boot, in this case an alpine ski boot 2*a*.

This embodiment is characterized by the location of the vertical spacer 133. The vertical spacer in FIG. 6 is interposed between the toe-piece 11*w* and the extension 21 of the boot 2*a*. Practically, the binding includes two vertical spacers 133 characterized, at least locally, by an adjustment height or thickness e3. That is, at least a portion of such a spacer includes the adjustment height. Each vertical spacer can be fixed on a lower surface 114*a*, 114*b* of a respective wing 113*a*, 113*b* of the front retaining device 11*w*. Thus, for this embodiment, the lower surfaces of the vertical spacer 133 form the upper abutment surface 111. The toe-piece 11*w* including the wings 113*a*, 113*b* therefore supports the vertical spacers 133 incorporating the upper abutment surface 111. In this example, the engagement height P, defined by the difference in height between the upper abutment surface 111 and the lower abutment surface 121, is substantially equal to the interface height Ha.

The toe-piece 11*w* is slightly different from the previous embodiments, because the body 112 is slightly higher. In this example, the toe-piece 11*w* is directly fixed on the ski 3 and the base plate 12, supporting the support element 122, is also directly fixed on the ski 3.

The vertical position of the toe-piece 11*w* does not vary depending upon the configurations of the binding, unlike the previous embodiments in which the toe-piece 11*u*, 11*v* is lowered in order to be compatible with an alpine ski boot 2*a*. The toe-piece 11*u*, 11*v*, when lowered, becomes more compact.

To switch to the second configuration, that is to say, to obtain the binding adapted to the category of touring ski boots 2*b*, it suffices to remove the vertical spacer 133. The new engagement height P is then increased by the dimension e3 and is therefore equal to "Ha+e3", whereby the interface height Ha or engagement height of the first configuration is added to the dimension e3 of the vertical spacer 133. As a result, the dimension e3 is substantially equal to "Hb−Ha" and is therefore equivalent to e1 and e2.

This variation is advantageous because the vertical spacer 133 can easily be added or removed without having to disassemble the toe-piece as in the previous embodiments. Indeed, given the fact that the vertical spacer 133 is fixed on portions that are accessible when the binding is assembled to the ski, the configuration change is facilitated.

This third embodiment is explained through the various solutions illustrated in FIGS. 8-16, which are described in detail below.

The first three embodiments described above have a common characteristic in that the support surface 122 still maintains the same vertical position, regardless of the configuration of the binding. This arrangement makes it possible to maintain a low position of the lower abutment surface 121, the closest to the gliding surface 32 of the ski. Such an adjustment makes it possible to maintain the spacing between the ski and the user's foot at an invariable and reduced value, which is favorable to the steering of the ski in the downhill position.

Figure 7:
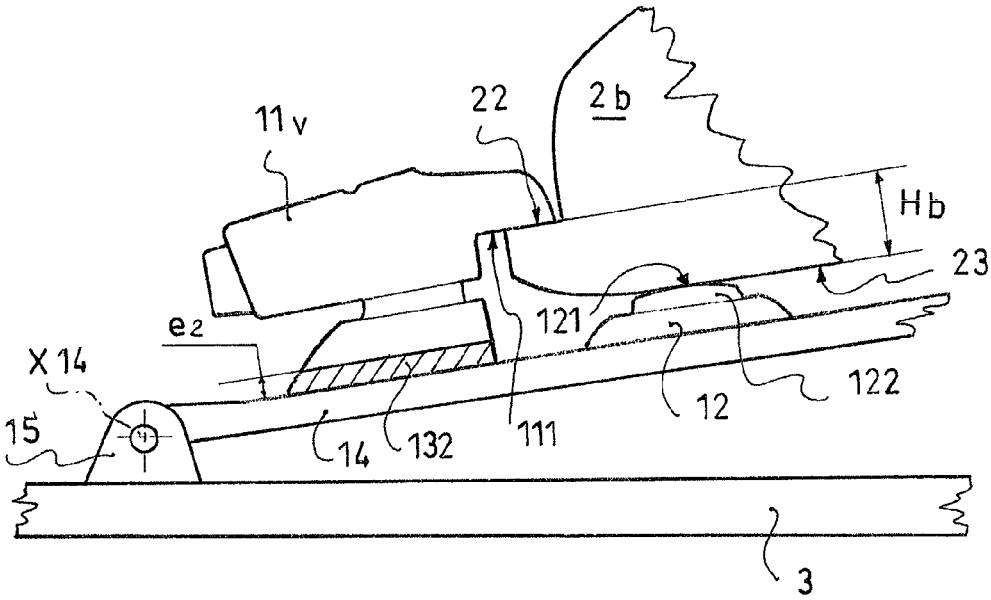
FIG. 7 is a schematic side view of a ski equipped with the front portion of a binding adapted to be compatible with a second category of footwear, according to a fourth embodiment.

FIG. 7 shows a fourth embodiment of the invention.

This embodiment is a variation of the second embodiment, in which the vertical spacer 132 and the base plate 12 are fixed on a plate 14 rotationally movable about an axis X14 supported by a stirrup 15. The difference is that the elements of the front portion 10 of the binding are not directly fixed on the ski 3 but are movable in relation to the ski 3. This type of configuration is commonly used for the practice of touring skiing.

Figure 8:
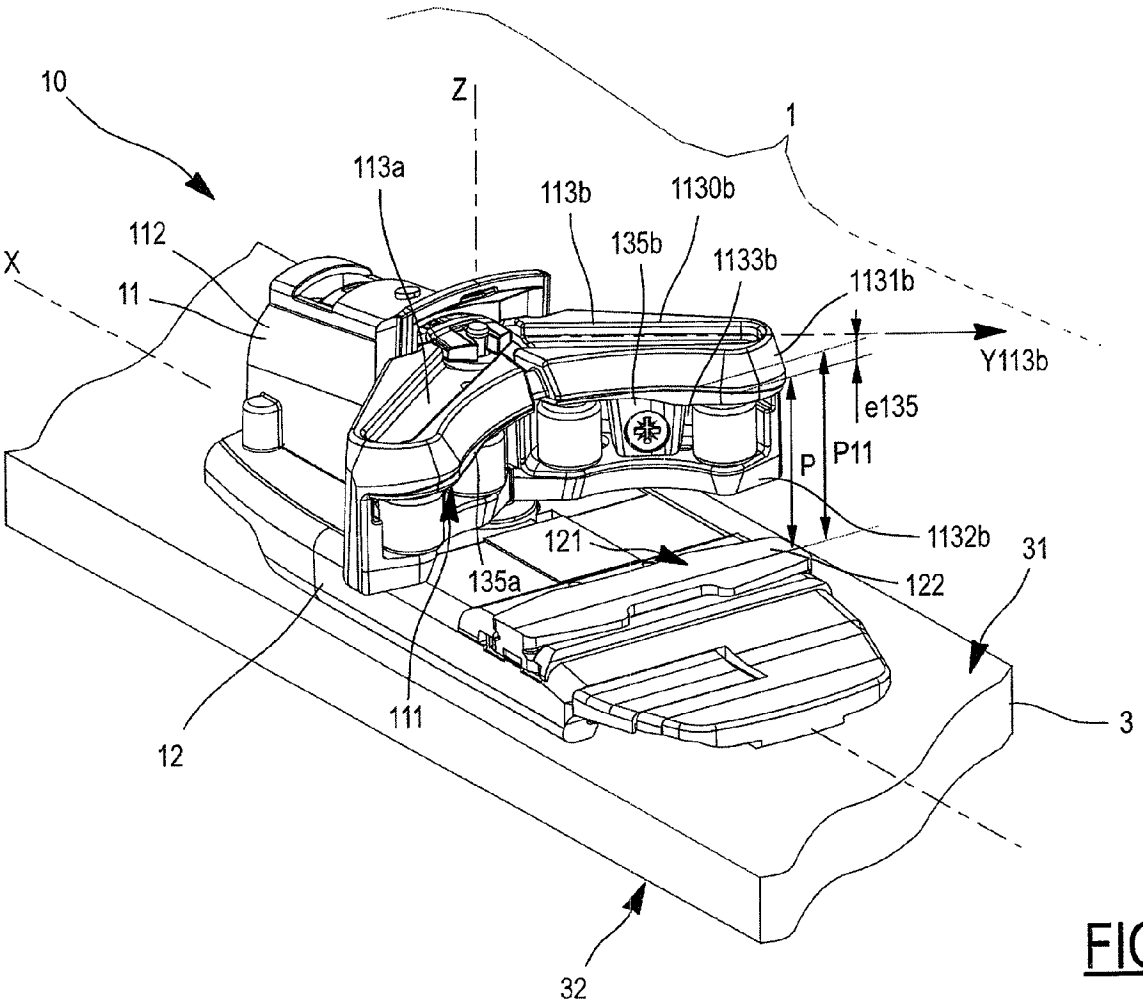
FIG. 8 is a perspective view of a first solution illustrating the third embodiment, the binding including two wings on which two first vertical spacers are fixed.
Figure 9:
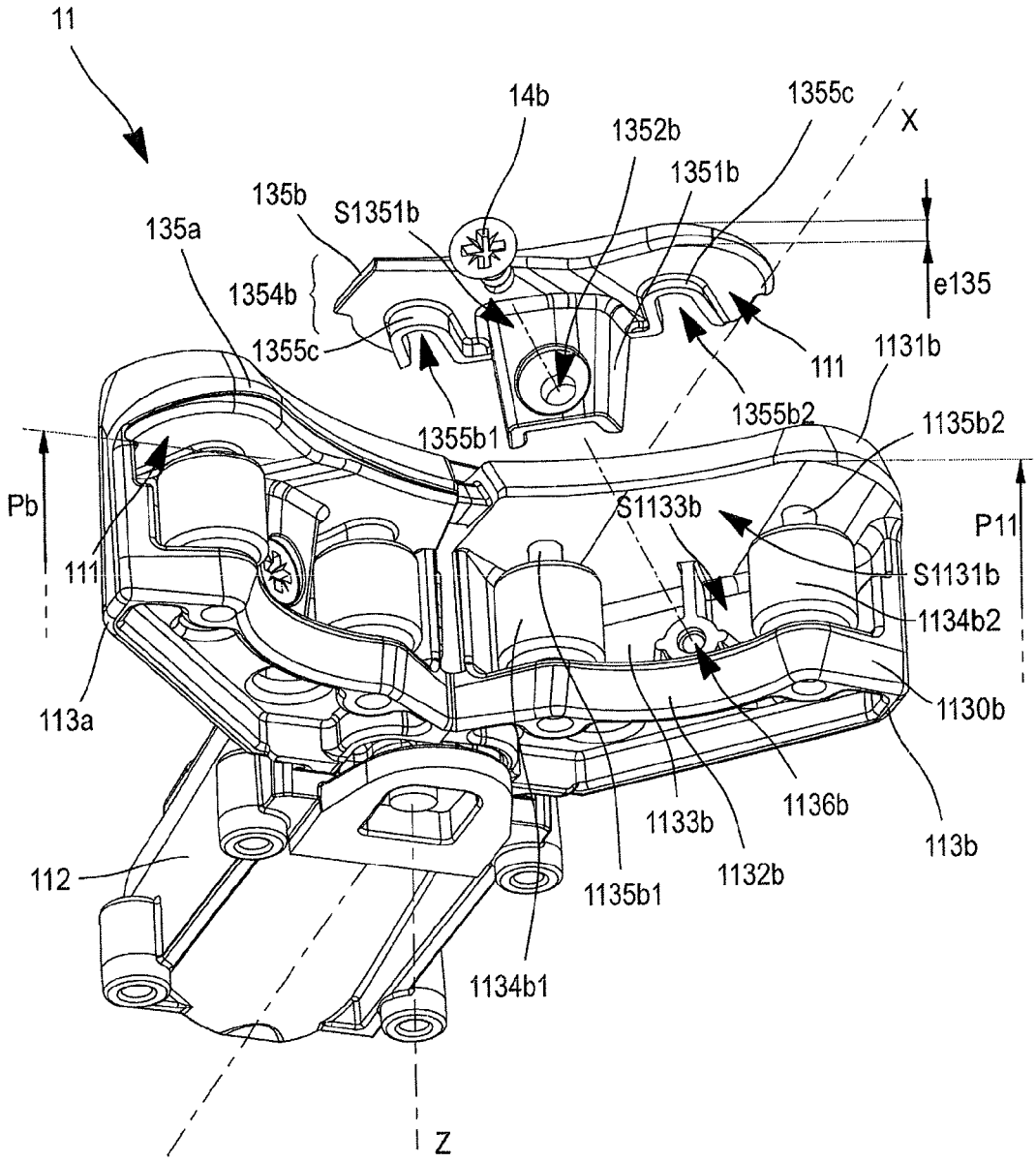
FIG. 9 is a perspective view of the binding of FIG. 8, from another angle, with one of the two first vertical spacers being disassembled.
Figure 10:
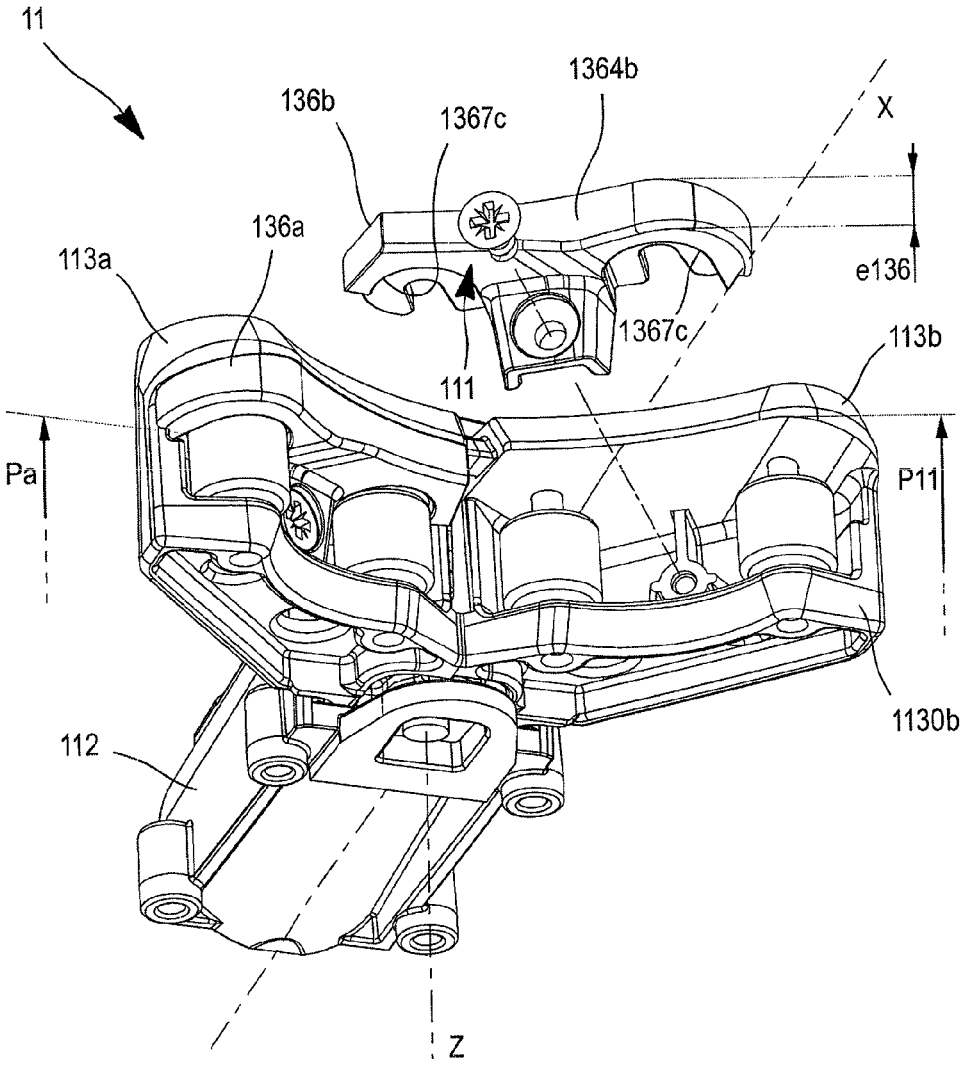
FIG. 10 is a view, similar to FIG. 9, of the binding of FIG. 8, the first two vertical spacers each being replaced by a second vertical spacer having a greater thickness.
Figure 11:
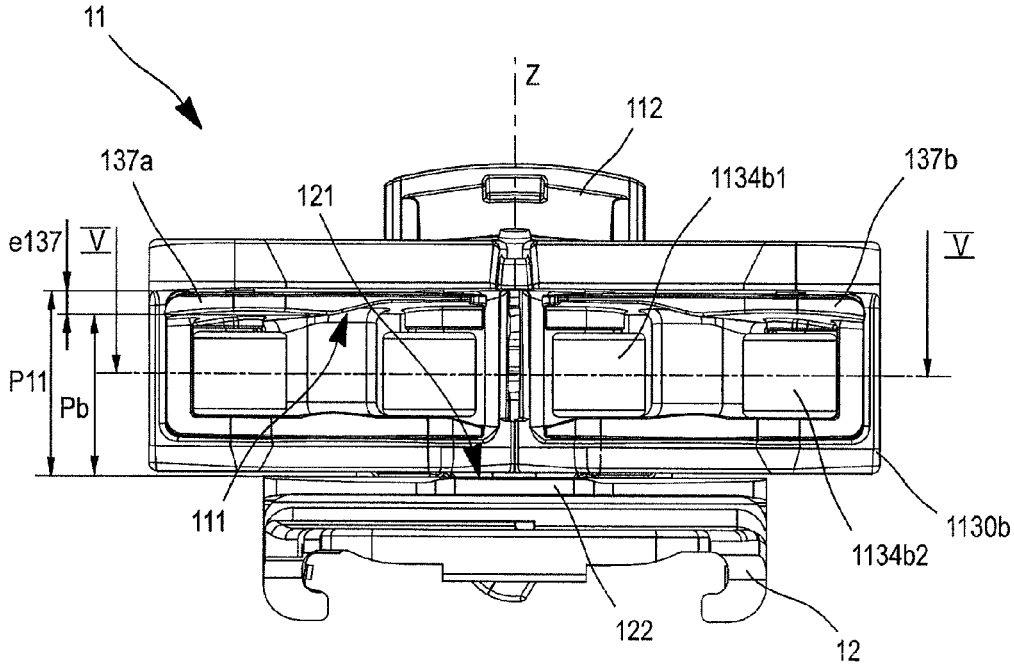
FIG. 11 is a rear view of a binding according to a second solution illustrating the third embodiment, this binding including two wings on which two third vertical spacers are mounted.
Figure 12:
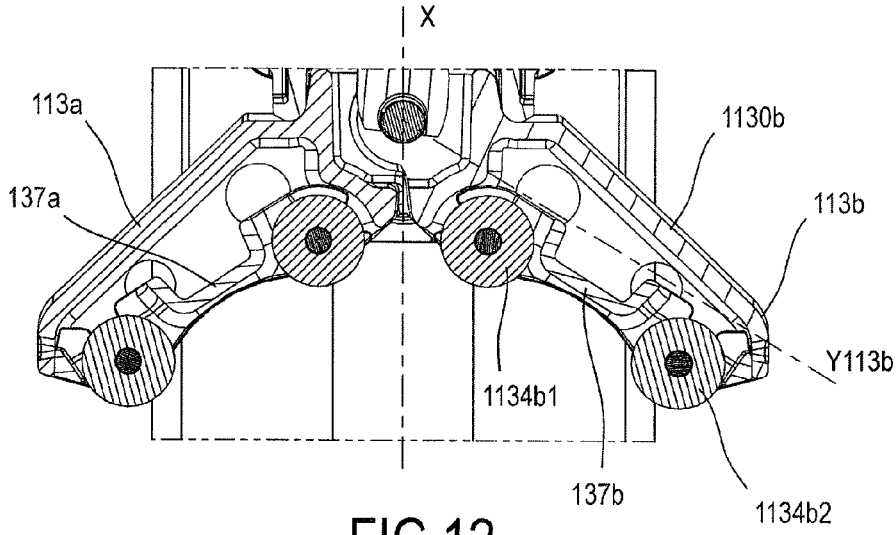
FIG. 12 is a partial cross section along the line V-V of FIG. 11.
Figure 13:
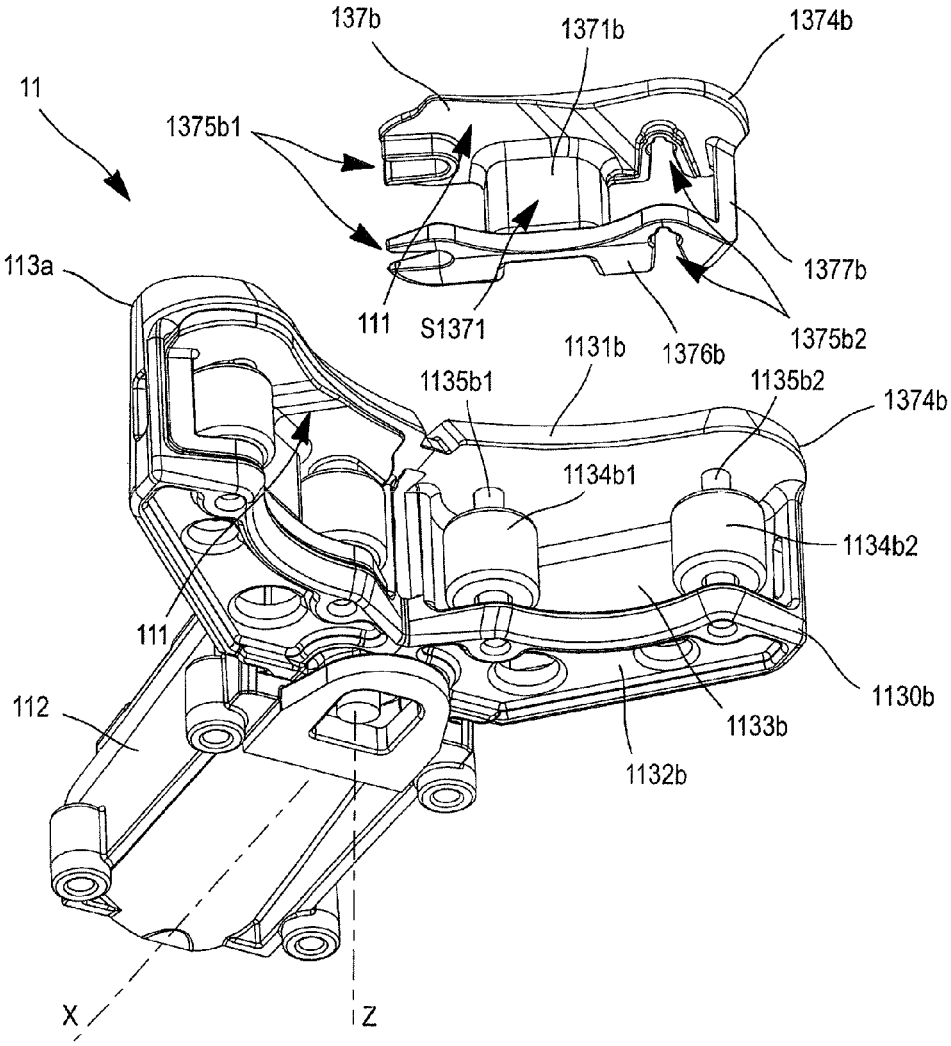
FIG. 13 is a view, similar to FIG. 9, of the binding of FIG. 11.

FIGS. 8-10 show a front portion 10 of a binding 1 of a boot 2*a* or 2*b* on a ski 3. The binding 1 further includes a rear portion, not shown, which includes a rear retaining device commonly known as the "heel-piece."

The front portion 10 includes a front retaining device 11, corresponding to the retaining device 11*w* of FIG. 6, commonly referred to as the "toe-piece", and a base plate 12 which is fixed to the ski 3, and on which the toe-piece 11 is fixed.

The ski 3 comprises a gliding surface 32 that contacts the snow during use of the ski 3, as well as an upper surface 31 which is parallel to the gliding surface 32, and on which the binding 1 is fixed. The ski 3 extends along a median longitudinal axis X which passes through the toe-piece 11 and the heel-piece. An axis Z of the ski 3 is defined, which is perpendicular to and intersects the axis X and is perpendicular to the surfaces 31 and 32 of the ski 3. When the gliding surface 32 rests on a horizontal flat surface, the axis Z is vertical. Thus, in the following description, the term "vertical" refers to a direction parallel to the axis Z.

For convenience, the description takes into account that the terms "upper" and "high" refer to a direction generally parallel to the axis Z and extends from the gliding surface 32 to the upper surface 31, that is to say, a direction toward the upper portion of FIGS. 8 to 10, whereas the terms "lower" and "low" refer to the opposite direction.

The description takes into account that the terms "front" and "anterior" refer to a direction generally parallel to the axis X and extends from the heel-piece to the toe-piece 11, that is to say, a direction towards the left portion of FIGS. 8 to 10, whereas the terms "rear" and "posterior" correspond to the opposite direction.

The base plate 12 includes a support element 122 comprising a lower abutment surface 121 facing upward and generally parallel to the surfaces 31 and 32 of the ski 3.

Each boot 2*a* and 2*b* comprises a lower surface 23 of the sole. A front extension 21 of the boot 2*a* is demarcated vertically along the axis Z, between the front end of the lower surface 23 and an upper surface 22 generally parallel to the lower surface 23.

The toe-piece 11 includes a body 112 supporting two similar wings 113*a* and 113*b*, each being rotationally movable in relation to the body 112 about the axis Z. In top view, the wings 113*a* and 113*b* form a "V" whose apex is directed towards the front of the ski 3.

For convenience and ease of understanding the description and drawings, only one wing 113*b* is described, it being understood that the structure of the second wing 113*a* is symmetrically identical with respect to a longitudinal median plane passing through the axes X and Z. Therefore, it must be understood that the wing 113*a* has characteristics similar to those of the wing 113*b* described below.

The wing 113*b* includes a support 1130*b*, a vertical spacer 135*b*, an element 14*b* for fixing the vertical spacer 135*b* on the support 1130*b*, two rollers 1134*b*1, 1134*b*2, and two shafts 1135*b*1, 1135*b*2. In the following description, the wings 113*a* and 113*b* are referred to as "fitted" wings, because they include at least one of the elements described above.

The support 1130*b* extends along an axis Y113*b*, perpendicular to and intersecting the axis Z, and forming a variable angle with the axis X as a function of the rotation of the fitted wing 113*b* about the axis Z.

The support 1130*b* comprises an upper wall 1131*b* and a lower wall 1132*b* that are generally parallel to the surfaces 31 and 32 of the ski 3, as well as a front wall 1133*b* generally perpendicular to the surfaces 31 and 32 of the ski 3. Thus, the support 1130*b* has a generally C-shaped cross section. The upper portion 1131*b* has a lower surface S1131*b* that is turned downward, in the direction of the base plate 12.

The width of the support 1130*b* is measured along an axis perpendicular to the axis Y113*b*, in a plane parallel to the surfaces 31 and 32 of the ski 3. The height of the support 1130*b* is measured along the axis Z. The width of the upper wall 1131*b* is greater than the width of the lower wall 1132*b*. Thus, the lower surface S1131*b* includes a rear portion which is opposite the base plate 12.

The support 1130*b* comprises a median or proximal roller 1134*b*1 and a lateral or distal roller 1134*b*2. These two rollers, cylindrical and circular in cross section, are each rotationally mounted about a shaft 1135*b*1, 1135*b*2 mounted substantially vertically on the support 1130*b*, that is to say, generally parallel to the axis Z. The median roller 1134*b*1 is closer to a longitudinal median plane of the ski 3, passing through the axes X and Z, than the lateral roller 1134*b*2.

The vertical spacer 135*b* can be rigid in the sense that it deforms slightly, or does not deform, when subject to forces which have an intensity close to the forces imposed by the boots 2*a* and 2*b* under standard conditions of use. In the context of the present application, an element is said to deform slightly if its dimensions vary by less than 5%.

According to this embodiment, the vertical spacer 135*b* forms a "T" defined by an upper portion 1354*b* and a fixing bracket 1351*b* extending perpendicular to the upper portion 1354*b*, in its center.

The fixing bracket 1351*b* comprises a hole 1352*b* provided for the passage of a fixing screw 14*b*. This fixing screw 14*b* constitutes the element for fixing the vertical spacer 135*b* on the support 1130*b*. The screw 14*b* therefore makes it possible to removably affix the vertical spacer 135*b* to the support 1130*b*. The front wall 1133*b* of the support 1130*b* comprises a rear surface S1133*b* turned toward the rear of the ski, that is to say, towards the boot 2*a* or 2*b*. The rear surface S1133*b* comprises an inner thread 1136*b* for fixing the screw 14*b*, provided between the two rollers 1134*b*1, 1134*b*2. The axis of the inner thread 1136*b* extends across the width of the support 1130*b*, that is to say, perpendicular to the axis Y113*b* or the front wall 1133*b*. The fixing bracket 1351*b* of the vertical spacer 135*b* comprises a rear surface S1351*b* facing the rear of the ski 3, opposite the front wall 1133*b*.

The fixing bracket 1351*b* of the vertical spacer 135*b* is pressed against the rear surface S1133*b* of the front wall 1133*b* of the support 1130*b*, which promotes the stability of the positioning of the vertical spacer 135*b*. This also provides a relatively large material thickness for making the inner thread 1136*b*, and thus promotes a strong attachment of the vertical spacer 135*b*.

The upper portion 1354*b* is substantially planar, or flat, and extends perpendicularly to the rear surface S1351*b* of the fixing bracket 1351*b*. The upper portion 1354*b* extends across the width of the support 1130*b*, that is to say, in a plane parallel to the surfaces 31 and 32 of the ski 3, or in a plane perpendicular to the rear surface S1133*b* of the front wall 1133*b* of the support 1130*b*. The upper portion 1354*b* is positioned between the upper 1131*b* and lower 1132*b* walls of the support 1130*b*, in contact with a lower surface S1131*b* of the upper wall 1131*b*. The upper portion 1354*b* has a geometry that is substantially identical to that of the upper wall 1131*b* of the support 1130*b*, so as to cover the lower surface S1131*b* of the support.

The upper portion 1354*b* comprises a median or proximal notch 1355*b*1 and a lateral or distal notch 1355*b*2 for the passage of the shafts 1135*b*1 and 1135*b*2 supporting the rollers 1134*b*1 and 1134*b*2.

The upper portion 1354*b* of the vertical spacer 135*b* has an upper abutment surface 111 turned downward, opposite to, and displaceable, along a horizontal plane, with respect to the lower abutment surface 121 of the base plate 12.

Dining use of the binding 1, the front extension 21 of the boot 2*a* cooperates with the fitted wings 113*a*, 113*b* of the toe-piece 11 and with the support element 112. When inserting the boot, the front extension 21 spaces the fitted wings 113*a* and 113*b* apart, by coming into contact with the rollers 1134*b*1, 1134*b*2 and similar rollers of the fitted wing 113*a*. Thus, during normal operation, the lateral horizontal and forward displacement of the boot 2*a* is limited only by the rollers 1134*b*1, 1134*b*2 and their equivalents. Consequently, the rear surface S1351*b* of the vertical spacers 135*b* is still set back, toward the front, in relation to a geometrical plane passing through the generating lines of the cylinders which define the rollers 1134*b*1, 1134*b*2, and which are in contact with the footwear when it is fixed to the ski 3.

Furthermore, the vertical displacement of the front extension 21 is limited in both directions by the abutment surfaces 111 and 121. These two surfaces 111 and 121 define an engagement height P. The sole 23 rests against the lower abutment surface 121, and the upper surface 22 of the front extension 21 is substantially blocked at the top by the upper abutment surfaces 111, except for the functional clearance.

The rollers 1134*b*1, 1134*b*2 and their equivalents facilitate the removal of the boot, that is to say, the lateral exit of the front extension 21 of the boot 2*a* or 2*b* out of the toe-piece 11, due to a safety mechanism.

In the embodiments being described, the boot 2*a* is an alpine ski boot, whereas the boot 2*b* is a touring ski boot, consistent with the NF ISO 5355 and NF ISO 9523 standards, respectively. The interface height Ha of the alpine ski boots 2*a* is less than the interface height Hb of the touring ski boots 2*b*.

As seen above, the blocking of the vertical displacement of a boot 2*a* or 2*b*, along the axis Z, is ensured by the binding 1. In the area of the front portion 10, the downward vertical stop is obtained via contact between the sole 23 of the boot 2*a* or 2*b* and the lower abutment surface 121. The upward vertical stop is obtained via contact between the upper surface 22 of the extension 21 of the boot 2*a* or 2*b* and the upper abutment surface 111. The engagement height P of the toe-piece 11 is equal to the height difference between the surfaces 121 and 111, measured along the axis Z.

To ensure proper retention of the boot 2*a* or 2*b*, the engagement height P must be substantially equal to the interface height Ha or Hb of the boot, except for the functional clearance, in order to facilitate the insertion of the boot.

Optionally, the retaining device 11 includes a complementary structure for the elastic adjustment of the engagement height P, as described above.

The vertical spacers 135*a* and 135*b* of FIGS. 8 and 9 have an identical adjustment height or thickness e135, measured in the area of the upper portion 1354*b* or equivalent, along the axis Z. The dimension e135 determines a first engagement height Pb adapted to retain a first category of boot, in this case a touring ski boot 2*b*.

In FIG. 10, the vertical spacers 135*a* and 135*b* are replaced by two vertical spacers 136*a* and 136*b* generally similar to the vertical spacers 135*a* and 135*b* of FIGS. 8 and 9. The vertical spacers 136*a* and 136*b* are different from the vertical spacers 135*a* and 135*b* by the adjustment height or thickness e136 of their upper portions 1364*b* and equivalents, which is strictly greater than the dimension e135 of the vertical spacers 135*a* and 135*b*. The vertical spacers 136*a* and 136*b* define a second engagement height Pa less than the engagement height Pb and adapted to retain the alpine ski boot 2*a*.

When the user wishes to use the binding 1 for touring ski boots 2*b*, the user positions the vertical spacers 135*a* and 135*b* and fixes them using the screws 14*a* and 14*b*. If the user later wishes to use alpine ski boots 2*a*, he/she removes the vertical spacers 135*a* and 135*b* by loosening the screws 14*a* and 14*b* and replacing them with the vertical spacers 136*a* and 136*b*, which have a greater dimension e136.

The vertical spacers 135*a*, 135*b*, 136*a*, and 136*b* are easily dismountable, without requiring disassembly of the toe-piece 11. This easy disassembly is illustrated with the vertical spacer 135*b*, for example. Due to the arrangement of the fixing bracket 1351*b* between the rollers 1134*b*1, 1134*b*2 of the fitted wing 113*b*, the screw 14*b* is directly accessible without it being necessary to disassemble a portion of the toe-piece 11 in order to reach it. To disassemble the screw 14*b*, the screwdriver is positioned horizontally, parallel to the surfaces 31 and 32 of the ski 3, and no portion of the ski 3 or of the binding 1 interferes with its use, i.e., its manipulation. The wings 113*a* and 113*b* are capable of receiving a vertical spacer, in the sense that the supports 1130*b* and equivalents are specially designed to receive a vertical spacer.

The notches 1355*b*1 and 1355*b*2 of the vertical spacer 135*b* are each bordered by a raised rib 1355*c* extending downward and taking support against the upper surface of the rollers 1134*b*1 and 1134*b*2. This contact promotes correct positioning of the rollers and retention of rollers, which increases their rigidity and prolongs the life of the binding 1. This correct positioning of the rollers also enables an improved operation of the safety mechanism when the boot is removed the boot.

The upper portion 1364*b* of the vertical spacer 136*b* of FIG. 10 comprises two semi-circular cutouts 1367*c* surrounding the upper portion of the lateral wall of the rollers 1134*b*1 and 1134*b*2. The cutouts 1367*c* retain each roller on both sides, along a direction perpendicular to the shafts. This contact also promotes correct positioning of the rollers and retention of the rollers.

An advantage of this binding is that it can easily adapt to various categories of boot, simply by changing a vertical spacer, while keeping the same retaining device 11. To this end, each fitted wing 113*a*, 113*b* includes a support S1130*b*, a lower surface S1131*b* of which, facing the lower abutment surface 121, is spaced vertically, that is to say, along the axis Z, from the lower abutment surface 121, when the retaining device 11 is affixed to the gliding board 3, by a distance P11 greater than or equal to at least two different values of interface heights Ha, Hb of specific boots 2*a*, 2*b*. In other words, the distance P11 is greater than or equal to the interface height Ha and greater than or equal to the interface height Hb at the same time. In the embodiment of FIG. 8, the distance P11 is greater than the two interface heights Ha, Hb. Thus, the distance P11 is greater than 28±3 mm.

Alternatively, the distance P11 is equal to the greatest of the interface heights Ha, Hb, in this case Hb. This variation requires only one set of vertical spacers in order to adapt to the boot 2*a*. Thus, when the binding 1 is used for a touring ski boot 2*b*, the toe-piece 11 is used without vertical spacer and has an engagement height Pb substantially equal to the interface height Hb. The boot 2*b* is then retained at the top by the lower surface S1131*b* of the support 1130*b*. When the binding 1 is used for an alpine ski boot 2*a*, the user positions a vertical spacer so that the toe-piece 11 defines an engagement height Pa less than the engagement height Hb. This binding also makes it possible to adapt to more than two categories of boots, by using at least two sets of vertical spacers of different thicknesses. In this case, the distance P11 must be greater than or equal to the greatest interface height of the compatible boots.

The binding 1 is aesthetic, as shown with the fitted wing 113*b*. The screw 14*b* is not exposed to view when the footwear is positioned in the toe-piece, because it is hidden by the support 1130*b* of the fitted wing. In addition, once the boot 2*a* or 2*b* is attached to the ski 3, the screw 14*b* is protected between the support 1130*b* and the boot 2*a* or 2*b*. Moreover, by being arranged between the support 1130*b* and the boot 2*a* or 2*b*, the vertical spacer 135*b* cannot accidentally be disassembled when skiing.

The use of a screw 14*b* for securing the vertical spacer 135*a*, 135*b*, 136*a*, 136*b* reinforces the retention of the vertical spacer onto the support 1130*b*. The invention encompasses the use of a specific screw head to prevent disassembly of the screw by a non-authorized person.

Because the vertical spacers 135*a*, 135*b*, 136*a*, and 136*b* are attached elements, it is possible to use different materials for the supports 1130*b* and equivalents and for the vertical spacers 135*b*, 136*b* and equivalents. For example, the vertical spacer 135*b* can be made from a synthetic material promoting good sliding of the boot 2*a* or 2*b* for the triggering of the safety mechanism during release of the boot, whereas the support 1130*b* can be made from a metallic alloy having high mechanical strength adapted to withstand the forces transmitted by the boot 2*a* or 2*b* to the binding 1.

FIGS. 11 to 16 show a second solution for achieving this third embodiment of the invention, in which the vertical spacers 135*a*, 135*b*, 136*a*, and 136*b* are replaced by vertical spacers 137*a* and 137*b* designed to be attached without the use of fixing screws, that is to say without using attached fixing means, the fixing of these vertical spacers being ensured by the intrinsic geometry of the vertical spacers. The vertical spacers 137*a* and 137*b* are removably fixed to a toe-piece 11 identical to the toe-piece 11 of FIGS. 8 to 10, except that the toe-piece 11 according to the second solution does not comprise any inner thread 1136*b*.

As seen above, this second solution is illustrated through the description of a single fitted wing 113*b*. It is to be understood that the characteristics described below also apply to the fitted wing 113*a*.

The vertical spacer 137*b* generally has the shape of an "I", defined by an upper portion 1374*b*, a lower portion 1376*b*, and a median portion 1371*b* connecting the upper portion to the lower portion 1376*b*. The lower portion 1376*b* of the vertical spacer 137*b* is closer to the ski 3 than the upper portion 1374*b*. The median portion 1371*b* of the vertical spacer 137*b* extends parallel to the axis Z and has a rear surface S1371*b* facing opposite the front wall 1133*b* of the support 1130*b*.

The upper portion 1374*b* and lower portion 1376*b* are substantially flat and extend parallel to the surfaces 31 and 32 of the ski 3, once assembled on the support 1130*b*. The vertical spacer 137*b* also comprises a lateral reinforcement 1377*b* which connects the upper portion 1374*b* to the lower portion 1376*b* and extends in the area of the lateral end of the vertical spacer 137*b*. This lateral reinforcement 1377*b* reinforces the retention of the vertical spacer 137*b* and serves as a support for the disassembly of the vertical spacer 137*b*. The upper portion 1374*b* of the vertical spacer 137*b* has a substantially flat upper abutment surface 111 extending parallel to the surfaces 31 and 32 of the ski 3 and facing downward, opposite to, and displaceable, along a horizontal plane, with respect to the lower abutment surface 121 formed by the base plate 12.

The lower portion 1376*b* of the vertical spacer 137*b* is not as wide, that is to say, along a direction perpendicular to the axis Y113*b*, as the upper portion 1374*b*. Thus, a rear portion of the upper portion 1374*b* extends opposite the base plate 12.

The upper portion 1374*b* and lower portion 1376*b* of the vertical spacer 137*b* each include a median notch 1375*b*1 and a lateral notch 1375*b*2 for the passage of the shafts 1135*b*1 and 1135*b*2 supporting the rollers 1134*b*1 and 1134*b*2. The median notch 1375*b*1 is oriented along the length of the vertical spacer 137*b*, whereas the lateral notch 1375*b*2 is oriented perpendicular to the length of the vertical spacer 137*b*. Thus, the median notch 1375*b*1 is perpendicular to the lateral notch 1375*b*2.

As with the first embodiment, the vertical displacement of the front extension 21 of the boot 2*b* is limited at the top by the upper abutment surfaces 111 of the vertical spacers 137*a* and 137*b*, and at the bottom by the lower abutment surface 121 of the base plate 12. During normal operation, as described above, the lateral horizontal and forward movement of the boot is limited only by the rollers of the fitted wings 113*a* and 113*b*.

The upper portion 1374*b* of the vertical spacer 137*b* has an adjustment height or thickness e137, measured along the axis Z, which determines an engagement height Pb, as defined above, adapted to retain a first category of footwear, in this case, a touring ski boot 2*b*.

Figure 14:
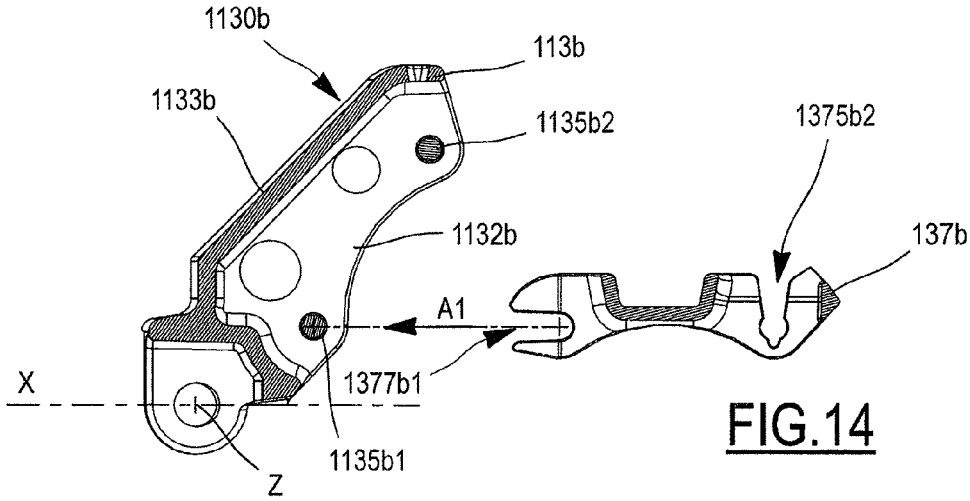
FIGS. 14 to 16 are partial cross sections along the line V-V of FIG. 11, showing one of the third vertical spacers, before assembly, during assembly, and after assembly with the wings of the binding, respectively.
Figure 15:
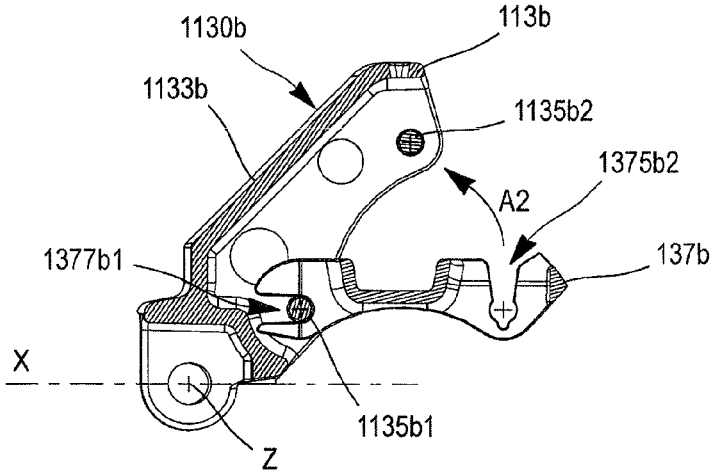
Figure 16:
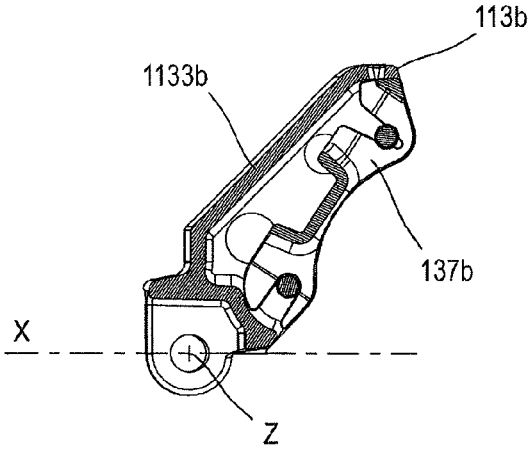

FIGS. 14, 15, and 16 illustrate the positioning of the vertical spacer 137*b* on the wing 113*b*, it being understood that the user proceeds as for the vertical spacer 137*a*.

In a first step, the vertical spacer 137*b* is presented parallel to the axis X, so that the median notch 1375*b*1 is directed toward the front of the ski 3 and in the direction of the shaft 1135*b*1 which receives the median roller 1134*b*.

In a second step, the user advances the vertical spacer 137*b* toward the median shaft 1137*b*1 along a translational movement parallel to the axis X represented by the arrow A1 in FIG. 14. The median shaft 1137*b*1 is positioned to abut against the bottom of the median notch 1375*b*1.

In a third step, the user pivots the vertical spacer 137*b* about the median shaft 1135*b*1, so as to bring the lateral shaft 1135*b*2 into the lateral notch 1375*b*2. The vertical spacer 137*b* is then fixed to the support 1130*b*. The geometry of the lateral notch 1375*b* is structured and arranged to removably snap-fasten the vertical spacer 137*b* onto the lateral shaft 1375*b*2. Advantageously, the vertical spacer 137*b* is not completely rigid to enable elastic deformation in the area of the lateral notch 1375*b*.

To separate the vertical spacer 137*b* from the support 1130*b*, it suffices to repeat the above steps in reverse order, by pivoting the vertical spacer 137*b* in the other direction and translating it in the opposite direction.

The notches 1375*b*1 and 1375*b*2 constitute first device for fixing the vertical spacer 137*b* on the support 1130*b*, which cooperate via snap-fastening with complementary fixing elements formed by the shafts 1135*b*2 mounted on the support 1130*b*.

To bind an alpine ski boot 2*a* to the toe-piece 11, the vertical spacers 137*a* and 137*b* are removed and replaced by two other vertical spacers, not shown, similar to the vertical spacers 137*a* and 137*b* and having a thickness greater than the thickness e137 of the vertical spacers 137*a* and 137*b*. These other vertical spacers then define an engagement height Pa less than the engagement height Pb.

Here again, once the boot 2*a* or 2*b* is fixed to the ski 3, the vertical spacer 137*b* is blocked between the support 1130*b* and the boot 2*a* or 2*b*, parallel to the axis X, thereby preventing the vertical spacer 137*b* from accidentally being disassembled when skiing.

This second solution is simple and makes it possible to fix the vertical spacers 137*a*, 137*b* without additional attachment elements such as screws. Indeed, the perpendicular orientation of the first notch 1375*b*1, with respect to the other notch 1375*b*2, ensures the retention of the vertical spacer 137*b*. The vertical spacers can thus be mounted without requiring the use of a tool.

For these solutions, it should be noted that the adjustment heights or thicknesses e135, e136, e137 of the upper portions 1354*b*, 1364*b*, 1374*b* and equivalents of the vertical spacers 135*a*, 135*b*, 136*a*, 136*b*, 137*a*, 137*b* make it possible to adjust the vertical position of the upper abutment surface 111.

The invention is described with references to wings 113*a*, 113*b* equipped with rollers but is not limited to this type of construction and also includes toe-pieces without rollers.

The upper portions 1354*b*, 1364*b*, 1374*b* and equivalents correspond to the insert portion of the vertical spacer 133 of the third embodiment shown in FIG. 6.

In the context of the invention, the solutions described can be combined, at least partially.

The various embodiments have been described to adapt to two categories of boots, namely alpine ski boots and touring ski boots. Also, the invention can be extended to other categories of footwear adapted to be fixed onto a gliding board. Similarly, the invention extends to any dimensional changes of the noted standards.

All of these embodiments have a simple adjustment of the binding to adapt to various categories of footwear. The addition of a rigid vertical spacer having a predetermined adjustment height reduces the time required to adjust the engagement height P. Thus, a vertical spacer corresponds to a category of footwear. Once configured, the binding cannot be put out of adjustment. The adjustment is therefore stable and reliable.

Any device for attaching the vertical spacer is encompassed by the invention. Such device can be screws, clip-on fasteners, etc., with or without necessitating the use of a tool. The solutions described in FIGS. 8 to 16 are an illustration. Alternatively, the vertical spacer can be assembled to the toe-piece via a sliding connection.

In certain embodiments (FIGS. 1 to 7), the adjustment of the retaining device for a first category of footwear requires at least one vertical spacer while the adjustment of the retaining device for a second category of footwear requires no vertical spacer. Alternatively, the binding can be designed so as to also require at least one other vertical spacer in order to adjust the retaining device for the second category of footwear (see solutions in FIGS. 8 to 16).

The adjustment principle per vertical spacer can also be applied to other portions of the binding, such as the rear portion including the heel-piece, for example.

In the context of the invention, the technical characteristics of the alternative embodiments described can be combined, at least partially. For example, the vertical spacer can be a simple plate or a more elaborate element having an insert portion. This insert portion is positioned so as to define the dimensions of the engagement height P.

The invention disclosed herein by way of exemplary embodiments suitably may be practiced in the absence of any element or structure which is not specifically disclosed herein.

The invention claimed is:

1. A binding for a boot on a gliding board comprising:

a retaining device supporting an upper abutment surface structured and arranged to be in contact with at least one upper surface of a front portion of the boot;

a lower abutment surface structured and arranged to be in contact with at least a portion of the sole of the boot, the lower abutment surface being connected to the retaining device so as to define an engagement height for the boot corresponding to a difference in height between the upper abutment surface and the lower abutment surface;

a rigid vertical spacer having an insert portion, at least a portion of the insert portion having a predetermined adjustment height;

the vertical spacer being structured and arranged in relation to the retaining device and the lower abutment surface, so that the adjustment height of the vertical spacer enables a modification of the engagement height;

the vertical spacer being directly affixed to the retaining device in order to modify a vertical position of the upper abutment surface;

the vertical spacer connecting the retaining device to a base structured and arranged to be affixed to the gliding board, the base supporting the lower abutment surface.

2. A binding according to claim 1, wherein:

the base is rotationally movable about a transverse axis in relation to the gliding board.

3. A binding for a boot on a gliding board comprising:

a retaining device supporting an upper abutment surface structured and arranged to be in contact with at least one upper surface of a front portion of the boot;

a lower abutment surface structured and arranged to be in contact with at least a portion of the sole of the boot, the lower abutment surface being connected to the retaining device so as to define an engagement height for the boot corresponding to a difference in height between the upper abutment surface and the lower abutment surface;

a rigid vertical spacer having an insert portion, at least locally having a predetermined adjustment height;

the vertical spacer being structured and arranged in relation to the retaining device and the lower abutment surface, so that the adjustment height of the vertical spacer enables a modification of the engagement height;

the vertical spacer being directly affixed to the retaining device in order to modify a vertical position of the upper abutment surface;

the vertical spacer being arranged between the retaining device and the front portion of the boot;

the retaining device comprising two fitted wings supporting the upper abutment surface, each fitted wing comprising a support on which the vertical spacer, forming the upper abutment surface, is removable fixed.

4. A binding according to claim 3, wherein:

the vertical spacer is fixed on the support without separating the retaining device from the gliding board.

5. A binding according to claim 3, wherein:

the vertical spacer is mounted on the fitted wing along a direction generally parallel to the abutment surfaces.

6. A binding according to claim 3, wherein:

each fitted wing comprises a support, a lower surface of the support facing the lower abutment surface, the support being vertically spaced from the lower abutment surface when the retaining device is affixed to the gliding board, by a distance greater than or equal to at least two different values of an interface height of specific boots.

7. A binding according to claim 3, wherein:

the retaining device comprises at least one roller for guiding the portion of the boot during removal of the boot, rotationally mounted about a shaft.

8. A binding according to claim 7, wherein:

the vertical spacer comprises at least one notch for passage of the shaft supporting the roller.

9. A binding according to claim 7, wherein:

the vertical spacer comprises a device for positioning the roller.

10. A binding according to claim 7, wherein:

the vertical spacer is mounted on the fitted wing via a snap-fastening connection to the shaft.

11. A binding according to claim 3, wherein:

the vertical spacer is fixed to the retaining device by at least one screw.

12. A binding according to claim 3, wherein:

the modification of the adjustment height comprises a modification of at least 9 mm.

13. An assembly comprising:

a gliding board;

a binding comprising:

a retaining device supporting an upper abutment surface structured and arranged to be in contact with at least one upper surface of a front portion of the boot;

a lower abutment surface structured and arranged to be in contact with at least a portion of the sole of the boot, the lower abutment surface being connected to the retaining device so as to define an engagement height for the boot corresponding to a difference in height between the upper abutment surface and the lower abutment surface;

a rigid vertical spacer having an insert portion, at least a portion of the insert portion having a predetermined adjustment height;

the vertical spacer being structured and arranged in relation to the retaining device and the lower abutment surface, so that the adjustment height of the vertical spacer enables a modification of the engagement height;

the vertical spacer being directly affixed to the retaining device in order to modify a vertical position of the upper abutment surface;

the vertical spacer connecting the retaining device to a base structured and arranged to be affixed to the gliding board, the base supporting the lower abutment surface.

14. An assembly comprising:

a gliding board;

a binding comprising:

a retaining device supporting an upper abutment surface structured and arranged to be in contact with at least one upper surface of a front portion of the boot;

a lower abutment surface structured and arranged to be in contact with at least a portion of the sole of the boot, the lower abutment surface being connected to the retaining device so as to define an engagement height for the boot corresponding to a difference in height between the upper abutment surface and the lower abutment surface;

a rigid vertical spacer having an insert portion, at least a portion of the insert portion having a predetermined adjustment height;

the vertical spacer being structured and arranged in relation to the retaining device and the lower abutment surface, so that the adjustment height of the vertical spacer enables a modification of the engagement height;

the vertical spacer being directly affixed to the retaining device in order to modify a vertical position of the upper abutment surface;

the vertical spacer being arranged between the retaining device and the front portion of the boot;

the retaining device comprising two fitted wings supporting the upper abutment surface, each fitted wing comprising a support on which the vertical spacer, forming the upper abutment surface, is removable fixed.

15. A binding for a boot on a gliding board comprising:

a retaining device supporting an upper abutment surface structured and arranged to be in contact with at least one upper surface of a front portion of the boot;

a lower abutment surface structured and arranged to be in contact with at least a portion of the sole of the boot, the lower abutment surface being connected to the retaining device so as to define an engagement height for the boot corresponding to a difference in height between the upper abutment surface and the lower abutment surface;

a rigid vertical spacer having an insert portion, at least a portion of the insert portion having a predetermined adjustment height;

the vertical spacer being structured and arranged in relation to the retaining device and the lower abutment surface, so that the adjustment height of the vertical spacer enables a modification of the engagement height;

the vertical spacer being directly affixed to the retaining device in order to modify a vertical position of the upper abutment surface;

the vertical spacer being structured and arranged to be positioned between the retaining device and an upwardly facing surface of the front portion of the boot.

16. A binding according to claim 15, wherein:

the retaining device comprises two fitted wings supporting the upper abutment surface, each fitted wing comprising a support on which the vertical spacer, forming the upper abutment surface, is removable fixed.

17. An assembly comprising:

a gliding board;

a binding comprising:

a retaining device supporting an upper abutment surface structured and arranged to be in contact with at least one upper surface of a front portion of the boot;

a lower abutment surface structured and arranged to be in contact with at least a portion of the sole of the boot, the lower abutment surface being connected to the retaining device so as to define an engagement height for the boot corresponding to a difference in height between the upper abutment surface and the lower abutment surface;

a rigid vertical spacer having an insert portion, at least a portion of the insert portion having a predetermined adjustment height;

the vertical spacer being structured and arranged in relation to the retaining device and the lower abutment surface, so that the adjustment height of the vertical spacer enables a modification of the engagement height;

the vertical spacer being directly affixed to the retaining device in order to modify a vertical position of the upper abutment surface;

the vertical spacer being structured and arranged to be positioned between the retaining device and an upwardly facing surface of the front portion of the boot.

18. An assembly according to claim 17, wherein:

the retaining device of the binding comprises two fitted wings supporting the upper abutment surface, each fitted wing comprising a support on which the vertical spacer, forming the upper abutment surface, is removable fixed.

* * * * *